US011697870B2

(12) United States Patent
Seals et al.

(10) Patent No.: US 11,697,870 B2
(45) Date of Patent: Jul. 11, 2023

(54) METHOD FOR PRODUCING STRAIGHTENED BETA-TITANIUM ALLOY ELONGATED PRODUCT FORMS

(71) Applicant: ATI Properties LLC, Albany, OR (US)

(72) Inventors: Mary E. Seals, Matthews, NC (US); Kayla J. Console, Indian Trail, NC (US); Patrick C. Markle, Charlotte, NC (US)

(73) Assignee: ATI PROPERTIES LLC, Albany, OR (US)

( * ) Notice: Subject to any disclaimer, the term of this patent is extended or adjusted under 35 U.S.C. 154(b) by 354 days.

(21) Appl. No.: 16/648,545

(22) PCT Filed: Sep. 20, 2018

(86) PCT No.: PCT/US2018/051982

§ 371 (c)(1),
(2) Date: Mar. 18, 2020

(87) PCT Pub. No.: WO2019/060566

PCT Pub. Date: Mar. 28, 2019

(65) Prior Publication Data

US 2020/0216941 A1 Jul. 9, 2020

Related U.S. Application Data

(60) Provisional application No. 62/561,349, filed on Sep. 21, 2017.

(51) Int. Cl.
*C22F 1/18* (2006.01)
*C22C 14/00* (2006.01)

(52) U.S. Cl.
CPC ..... *C22F 1/183* (2013.01); *C22C 14/00* (2013.01)

(58) Field of Classification Search
None
See application file for complete search history.

(56) References Cited

U.S. PATENT DOCUMENTS

2005/0257864 A1 11/2005 Marquardt et al.
2007/0193662 A1 8/2007 Jablokov et al.
2012/0024033 A1 2/2012 Bryan

OTHER PUBLICATIONS

Harmer, Steve. "Heat Treatment of Steels—Distortion and Dimensional Control" Materials Information Service Apr. 30, 2001. https://www.azom.com/article.aspx?ArticleID=353 (Year: 2001).*
ATI 15Mo™ Titanium Alloy, Technical Data Sheet, Allegheny Technologies Incorporated, Version 2, Apr. 23, 2014, 4 pages.
(Continued)

*Primary Examiner* — Anthony M Liang
*Assistant Examiner* — Danny N Kang
(74) *Attorney, Agent, or Firm* — Robert J. Toth; K&L Gates LLP

(57) ABSTRACT

A method of producing a beta-titanium alloy elongated product form having a chemical composition as specified in UNS R58150 or ASTM F2066-13. The method comprises solution treating, aging, straightening, stress-relief aging, and cooling the elongated product form. Articles of manufacture comprising or produced from beta-titanium alloy elongated product forms made according to the method also are disclosed.

16 Claims, 2 Drawing Sheets

(56) References Cited

OTHER PUBLICATIONS

Standard Specification for Wrought Titanium-15 Molybdenum Alloy for Surgical Implant Applications (UNS R58150), Designation: F2066/F2066M-13, ASTM International, Nov. 2013, 6 pages.
Donachie Jr., M., Titanium, A Technical Guide, Second Edition, ASM International, 2000, pp. 36-37.
International Search Report and Written Opinion of the International Searching Authority for International Application No. PCT/US18/51982 dated Jan. 9, 2019.

* cited by examiner

METHOD FOR PRODUCING STRAIGHTENED BETA-TITANIUM ALLOY ELONGATED PRODUCT FORMS

BACKGROUND OF THE TECHNOLOGY

Field of the Technology

The present disclosure is directed to methods for producing straightened beta-titanium alloy elongated product forms.

DESCRIPTION OF THE BACKGROUND OF THE TECHNOLOGY

Titanium alloys typically exhibit improved corrosion fatigue properties, have reduced nickel content, and exhibit ductility similar to or improved over existing biomedical stainless steel grades. As such, titanium alloys are often employed in medical device applications including, for example, structural orthopedic implant applications.

Available beta-titanium alloys include, for example, Ti-15Mo alloy, which has a composition as specified in UNS R58150 or ASTM F2066-13. For certain biomedical applications, Ti-15 Mo alloy is produced in bar or rod product forms or in other elongated product forms that must exhibit certain minimum mechanical properties and also meet very tight tolerances for straightness. During the production of Ti-15Mo alloy bars, rods, and other elongated product forms, the forms may be solution treated and aged (STA) and then subjected to one or more room temperature or elevated temperature straightening operations to impart required straightness to the product forms. The straightening operations, however, can result in a significant loss of tensile strength in STA Ti-15Mo elongated product forms such that the forms no longer exhibit required mechanical properties.

Accordingly, it is desirable to provide a method for producing straightened STA Ti-15Mo elongated product forms that exhibit acceptable mechanical properties for certain product applications.

SUMMARY

According to one aspect of the present disclosure, a non-limiting embodiment of a method of producing a straightened beta-titanium alloy elongated product form includes solution treating a beta-titanium alloy product form having a chemical composition as specified in UNS R58150 or ASTM F2066-13, and aging the solution treated beta-titanium alloy product form in a first temperature range of 482° C. to 510° C. A stress is applied to the solution treated and aged (STA) beta-titanium alloy product form in a second temperature range of ambient temperature to 482° C. for a time sufficient to improve straightness of the solution treated and aged beta-titanium alloy product form, to provide a straightened solution treated and aged beta-titanium alloy elongated product form. The straightened solution treated and aged beta-titanium alloy elongated product form deviates from straight by no greater than 0.0625 inch (1.588 mm) over any 5 foot length (152.4 cm). The straightened solution treated and aged beta-titanium alloy elongated product form is stress-relief aged in a third temperature range of 426° C. to 510° C., to provide a stress-relief aged beta-titanium alloy elongated product form. The stress-relief aged beta-titanium alloy elongated product form is air cooled from the third temperature range.

Another non-limiting aspect of the present disclosure is directed to an article of manufacture comprising or produced from a stress-relief aged and air cooled beta-titanium alloy elongated product form made according to the method of the present disclosure. In one particular non-limiting embodiment, the article of manufacture is a surgical implant device or a part therefor. Specific non-limiting examples of possible surgical implant devices and parts that may include or be made from embodiments of the elongated product forms described in the present disclosure include: a component for partial and total hip and knee replacement, an intermedullary rod, a fracture plate, a spinal fixation replacement component, a spinal disc replacement component, a trauma screw, a trauma plate, a wire, a cable, a fastener, a screw, a nail, an anchor, a dental casting, a dental implant, an orthodontic arch wire, an orthodontic anchor, a heart valve ring, a heart valve component, profile and plate stocks, a tool, an instrument, a fastener, and an item of hardware.

BRIEF DESCRIPTION OF THE DRAWINGS

Features and advantages of embodiments of methods described herein may be better understood by reference to the accompanying drawings in which.

The reader will appreciate the foregoing details, as well as others, upon considering the following detailed description of certain non-limiting embodiments of methods and articles according to the present disclosure.

DETAILED DESCRIPTION OF CERTAIN NON-LIMITING EMBODIMENTS

In the present description of non-limiting embodiments and in the claims, other than in the operating examples or where otherwise indicated, all numbers expressing quantities or characteristics of ingredients and products, processing conditions, and the like are to be understood as being modified in all instances by the term "about." Accordingly, unless indicated to the contrary, any numerical parameters set forth in the following description and the attached claims are approximations that may vary depending on the desired properties one seeks to obtain in the methods and alloy elongated product forms according to the present disclosure. At the very least, and not as an attempt to limit the application of the doctrine of equivalents to the scope of the claims, each numerical parameter should at least be construed in light of the number of reported significant digits and by applying ordinary rounding techniques.

Figure 1:
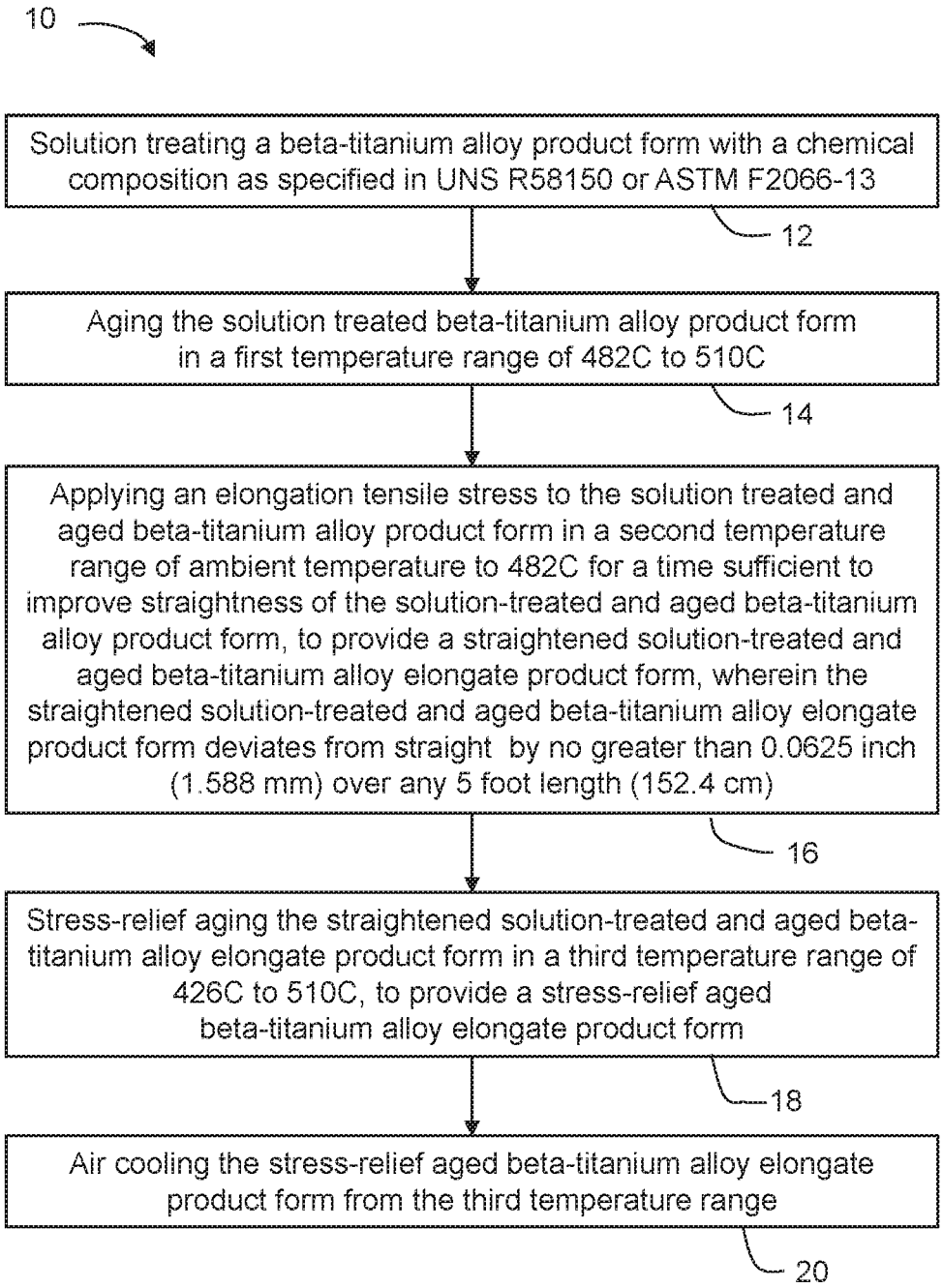
FIG. 1 is a flow diagram of a non-limiting embodiment of a method for producing a straightened beta-titanium alloy elongated product form according to the present disclosure.

Referring now to the flow diagram of FIG. 1, the present disclosure, in part, is directed to improved methods for producing straightened STA beta-titanium alloy elongated product forms. As used herein, an "elongated" product form is a product form having a length dimension that is at least twice as great as a width dimension of the product form. Examples of elongated product forms may include, for example, a billet, a bloom, a round bar, a square bar, an extrusion, a tube, a pipe, a slab, a sheet, and a plate. In the method embodiment illustrated in FIG. 1, the beta-titanium alloy elongated product form comprises Ti-15Mo alloy, which may have a chemical composition as specified in UNS R58150 or in ASTM F2066-13 ("Standard Specification for Wrought Titanium-15 Molybdenum Alloy for Surgical Implant Applications (UNS R58150)"). Table 1 lists the required chemical composition (in weight percentages) and the allowable tolerance (wt. %) under the listed minimum value[1] and over the listed maximum value for wrought Ti-15Mo alloy for surgical implant applications set out in ASTM F2066-13. It will be understood that the balance of the Ti-15Mo alloy of Table 1 consists of titanium and any other elements present as incidental impurities.

[1] Under the minimum limit is not applicable for elements in Table 1 that may be absent in the alloy.

TABLE 1

| | Mo | Fe | H | N | O | C | Ti |
|---|---|---|---|---|---|---|---|
| wt. % min. | 14.000 | 0 | 0 | 0 | 0 | 0 | Balance |
| wt. % max. | 16.000 | 0.100 | 0.0150 | 0.0500 | 0.200 | 0.100 | |
| Tolerance under the min. or over the max. (wt. %) | 0.25 | 0.10 | 0.0020 | 0.02 | 0.02 | 0.02 | |

As used herein, "STA" (solution treated and aged) refers to a heat treating process applied to beta-titanium alloys that includes solution treating a beta-titanium alloy at a solution treating temperature at or near the beta-transus temperature of the titanium alloy. The solution treated alloy is then aged by heating the alloy for a period of time in an aging temperature range that is less than the beta-transus temperature of the beta-titanium alloy.

With reference to FIG. 1, a non-limiting embodiment 10 of a method for producing a straightened beta-titanium alloy product form according to the present disclosure comprises solution treating (block 12) a beta-titanium alloy product form having a chemical composition as specified in UNS R58150 or ASTM F2066-13 (see Table 1). In a non-limiting embodiment, a solution treatment time ranges from about 30 minutes to about 2 hours. It is recognized that in certain non-limiting embodiments, the solution treatment time may be shorter than 30 minutes or longer than 2 hours and is generally dependent upon the size and cross-section of the beta-titanium alloy product form. Upon completion of the solution treatment, the beta-titanium alloy product form is water quenched. The solution treating step provides a solution treated beta-titanium alloy product form.

The solution treated beta-titanium alloy product form is subsequently aged (block 14) at an aging temperature, also referred to herein as an "age hardening temperature", that is in the $\alpha+\beta$ two-phase field below the beta-transus temperature of the titanium alloy. In a non-limiting embodiment, the aging temperature is in a first temperature range from about 482° C. to about 510° C. In certain non-limiting embodiments of method 10, the aging time may range from about 30 minutes to about 8 hours. It is recognized that in certain non-limiting embodiments, the aging time may be shorter than 30 minutes or longer than 8 hours longer and is generally dependent upon the size and cross-section of the titanium alloy product form. A solution treating and aging (STA) process can produce titanium alloys exhibiting high yield strength and high ultimate tensile strength. General techniques used in STA processing titanium alloys are known to practitioners of ordinary skill in the art and, therefore, are not further discussed herein.

Subsequent to aging (block 14) the beta-titanium alloy product form, a stress (e.g., a bending stress) is applied (block 16) to the STA product form while in a second temperature range of ambient temperature to 482° C. for a time sufficient to improve straightness of the product form, thereby providing a straightened STA beta-titanium alloy elongated product form. In a non-limiting embodiment, the stress applied at straightening is at least as great as the yield stress of the STA beta-titanium alloy product form at the straightening temperature. In a non-limiting embodiment, the applied stress may be increased during one or more straightening steps in order to maintain straightness of the product form during the step. In a non-limiting embodiment, for example, the stress may be increased by a factor of 2 during one or more straightening steps.

Figure 2:
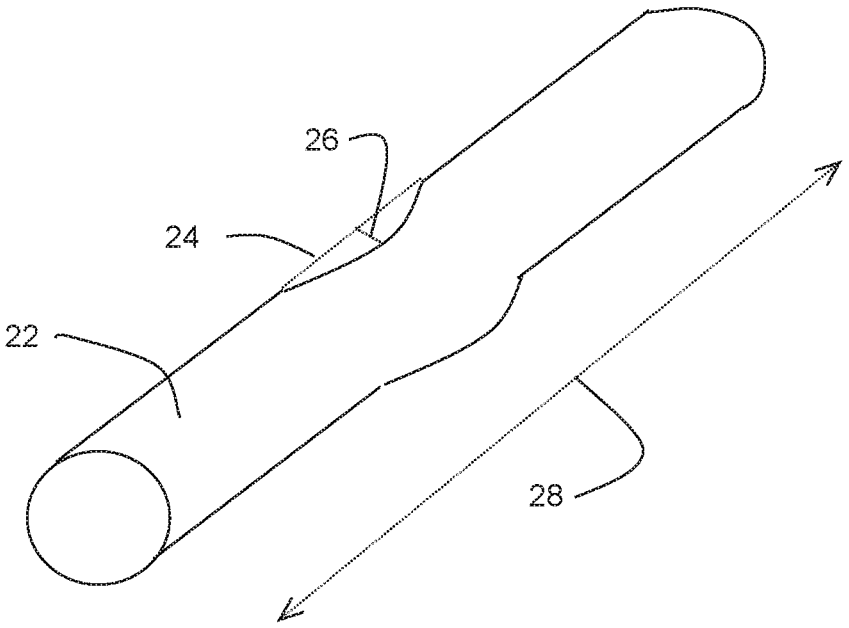
FIG. 2 is a schematic representation of a technique for measuring the deviation from straight of an elongated product form.

Referring to the schematic of FIG. 2, in a method for determining the deviation from straight of an elongated product form such as, for example, a bar 22, the bar 22 is lined up next to a straight edge 24. The curvature of the bar 22 is measured at curved or twisted locations on the bar with a device used to measure length, such as a tape measure, as the distance the bar curves away from the straight edge 24. The distance of each twist or curve from the straight edge is measured along a prescribed length of the bar 28 to determine the maximum deviation from straight (26 in FIG. 2), i.e., the maximum distance of the bar 22 from the straight edge 24 within the prescribed length of the bar 22. The same technique may be used to quantify deviation from straight for other elongated product forms.

In a non-limiting embodiment, subsequent to applying the stress (block 16) to increase straightness of the beta-titanium alloy elongated product form, the straightened elongated product form deviates from straight by no greater than 0.0625 inch (1.588 mm) over any 5 foot length (152.4 cm) of the elongated product form. In another non-limiting embodiment, after applying the stress in the straightening step according to the present disclosure, the straightened STA beta-titanium alloy elongated product form deviates from straight by no greater than 0.125 inch (3.175 mm) over any 10 foot length (304.8 cm) of the straightened STA beta-titanium alloy elongated product form. For straightened elongated product forms less than 5 feet in length, the deviation from straight in certain non-limiting embodiments is no greater than 0.0625 inch (1.588 mm) over the entire length of the product form.

Referring again to FIG. 1, subsequent to applying the stress in the straightening step (block 16), the straightened STA beta-titanium alloy elongated product form is stress-relief aged (block 18) in a third temperature range of about 426° C. to about 510° C., to provide a stress-relief aged beta-titanium alloy elongated product form. In certain non-limiting embodiments, the stress-relief aging time is up to 2 hours. For example, the straightened STA beta-titanium alloy elongated product form can be maintained within the third temperature range for about 30 minutes to about 2 hours, for about 30 minutes to about 1 hour, or for about 1 hour to about 2 hours. As used herein, phrases such as "maintained at" with reference to a temperature, temperature range, or minimum temperature mean that at least a desired portion of the beta-titanium alloy elongated product form reaches, and is held at, a temperature at least equal to the referenced temperature or within the referenced temperature range. It is recognized that in certain non-limiting embodiments, the stress-relief aging time may be shorter than 30 minutes or longer than 2 hours and is generally dependent upon the size and cross-section of the beta-titanium alloy elongated product form.

In a non-limiting embodiment, the straightened STA beta-titanium alloy elongated product form defines a longitudinal axis, and the longitudinal axis is positioned substantially perpendicular to a support structure during the stress-relief aging step (block 18) to inhibit distortion of the elongated product form. For example, the straightened STA beta-titanium alloy elongated product form may be suspended in a vertical furnace during the stress-relieving.

Subsequent to completion of the stress-relief aging treatment (block 18), the beta-titanium alloy elongated product form is air cooled (block 20) from the stress-relief aging temperature range. For example, a stress-relief aged beta-titanium alloy elongated product form processed according to the method described herein may be convectively air cooled by forced air currents flowing over the stress-relief aged beta-titanium alloy elongated product form, or the stress-relief aged beta-titanium alloy elongated product form may be convectively air cooled in an ambient air environment without forced air flow. Also, for example, a stress-relief aged beta-titanium alloy elongated product form processed according to the method described herein may be conductively cooled by the transfer of heat from the elongated product form into any processing equipment surfaces in contact with the elongated product form. In various non-limiting embodiments, a stress-relief aged beta-titanium alloy elongated product form processed according to the method described herein may be both convectively air cooled and conductively cooled. In various non-limiting embodiments, a stress-relief aged beta-titanium alloy elongated product form processed according to the present method may be cooled without liquid quenching. In certain non-limiting embodiments, the stress-relief aged beta-titanium alloy elongated product form may be suspended in a vertical orientation during the air cooling.

The present inventors observed that straightened Ti-15Mo alloy elongated product forms produced by a method as described in the present disclosure exhibit significantly higher ultimate tensile strength and yield strength, and do not exhibit significantly reduced percent elongation, than straightened Ti-15Mo elongated product forms processed in substantially the same way but without the stress-relief aging step of the present method. In a non-limiting embodiment of the present method, for example, after stress-relief aging and air cooling according to the method of the present disclosure, a straightened Ti-15Mo alloy elongated product form exhibits an ultimate tensile strength of at least 1175 MPa, and in certain embodiments from 1175 MPa to 1230 MPa, and a percent elongation of at least 10%. In another non-limiting embodiment, after stress-relief aging and air cooling according to the method of the present disclosure, a straightened Ti-15Mo alloy elongated product form exhibits a yield strength of at least 1080 MPa, and in certain embodiments from 1080 MPa to 1153 MPa, and a percent elongation of at least 10%.

For a given alloy, ultimate tensile strength and yield strength are each generally inversely related to percent elongation. In a non-limiting embodiment according to the present disclosure, a stress-relief aged and air cooled straightened Ti-15Mo alloy elongated product form made according to the present method exhibits an ultimate tensile strength that is at least as great as, and is up to 5% greater than, an ultimate tensile strength of the straightened STA Ti-15Mo alloy elongated product form, without significantly reducing the percent elongation of the straightened STA Ti-15Mo alloy elongated product form. In another non-limiting embodiment according to the present disclosure, the stress-relief aged and air cooled Ti-15Mo alloy elongated product form exhibits a yield strength that is at least as great as, and is up to 6% greater than, a yield strength of the straightened STA Ti-15Mo alloy elongated product form, without significantly reducing the percent elongation of the straightened STA Ti-15Mo alloy elongated product form.

Certain embodiments of alloy elongated product forms produced according the present disclosure and articles made from those elongated product forms may be advantageously applied in biomedical (i.e., medical and/or surgical) applications such as, for example: a component for partial and total hip and knee replacement, an intermedullary rod, a fracture plate, a spinal fixation replacement component, a spinal disc replacement component, a trauma screw, a trauma plate, a wire, a cable, a fastener, a screw, a nail, an anchor, a dental casting, a dental implant, an orthodontic arch wire, an orthodontic anchor, a heart valve ring, a heart valve component, profile and plate stocks, a tool, an instrument, a fastener, and an item of hardware. Moreover, certain embodiments of alloy elongated product forms produced according the present disclosure and articles made from those elongated product forms may be advantageously applied in certain non-biomedical applications including, for example equipment and parts used in one or more of the following applications: aerospace applications, automotive applications, nuclear applications, power generation applications, jewelry, and chemical processing applications. Specific non-limiting examples of possible non-surgical equipment and parts include: automotive torsions bars, aerospace fasteners, corrosion-resistant thin sheet for military and commercial aircraft, high performance racing and motorcycle springs, and corrosion-resistant chemical processing tubing and fasteners.

Those having ordinary skill in the art will be capable of fabricating the foregoing equipment, parts, and other articles of manufacture from alloy product forms made according to the methods of the present disclosure without the need to provide further description herein.

The foregoing examples of possible applications for beta-titanium alloy elongated product forms made according to the present disclosure are offered by way of example only, and are not exhaustive of all applications in which the present beta-titanium alloy elongated product forms may be applied. Those having ordinary skill, upon reading the present disclosure, may readily identify additional applications for the alloy elongated product forms made as described herein. Also, those having ordinary skill in the art will be capable of fabricating articles used in such additional applications without need for additional discussion herein. Accordingly, further discussion of possible fabrication procedures for such articles is unnecessary.

The examples that follow are intended to further describe certain non-limiting embodiments, without restricting the scope of the present invention. Persons having ordinary skill in the art will appreciate that variations of the following examples are possible within the scope of the invention, which is defined solely by the claims.

EXAMPLES

Several bars of Ti-15Mo alloy having chemical compositions within the UNS R58150 specification and weighing about 316 lb in total were fabricated. Each bar ranged in length from 60.19 inches to 141.44 inches (152.9 cm to 359.3 cm), with a diameter of 0.63 inches (1.6 cm). The bars were, in sequence, solution treated in a vertical furnace at a temperature of 1340° F. (726° C.) for 1 hour, followed by a water quench, then aged in a vertical furnace at an aging temperature of 950° F. (510° C.) for 6 hours, followed by air cooling, then warm rotary straightened using a bar straightener manufactured by Medart Inc., and then stress-relief aged in a vertical furnace at 850° F. (454° C.) for 1 hour, followed by air cooling in still air. The tensile properties of the STA bars were compared with straightened bars before and after the stress relief aging step, and the results are presented in Table 2. The stress relief aging treatment significantly improved yield strength and ultimate tensile strength of the straightened bars.

TABLE 2

| Description | Gage Section (inch) | Test Sample | YS (ksi) | UTS (ksi) | EL (%) | RA (%) |
|---|---|---|---|---|---|---|
| Solution Treated and Aged (STA) Bars | | | | | | |
| Sub-size tensile test | 0.350 | 1 | 157.2 | 168.6 | 15.4 | 69.6 |
| Sub-size tensile test | 0.350 | 2 | 154.7 | 168.3 | 16 | 71.3 |
| Sub-size tensile test | 0.350 | 3 | 163.3 | 177.1 | 13.7 | 63.5 |
| Sub-size tensile test | 0.350 | 4 | 160.2 | 173.9 | 14.3 | 67.9 |
| Full-size tensile test | 0.505 | 5 | 150.11 | 160.84 | 21.64 | 72.76 |
| Full-size tensile test | 0.505 | 6 | 149.82 | 161.57 | 19.72 | 73.46 |
| Full-size tensile test | 0.505 | 7 | 153.16 | 165.34 | 19.8 | 26.82 |
| Full-size tensile test | 0.505 | 8 | 148.95 | 159.69 | 21.78 | 69.97 |
| Full-size tensile test | 0.505 | 9 | 155.92 | 166.5 | 14.5 | 69.41 |
| Full-size tensile test | 0.505 | 10 | 144.02 | 153.3 | 21.82 | 72.09 |
| Straightened Bars - Pre-Stress Relief | | | | | | |
| Full-size tensile test | 0.505 | Baseline | 151 | 165.9 | 16 | 69.8 |
| Straightened Bars - Post-Stress Relief | | | | | | |
| Full-size tensile test | 0.505 | 1 | 157.6 | 172 | 16 | 65 |
| Full-size tensile test | 0.505 | 2 | 160.8 | 175 | 14 | 65 |
| Full-size tensile test | 0.505 | 3 | 164.2 | 178.4 | 14 | 66 |
| Full-size tensile test | 0.505 | 4 | 156.7 | 170.5 | 14 | 67 |
| Full-size tensile test | 0.505 | 5 | 167.3 | 177 | 14 | 65 |

The present disclosure has been written with reference to various exemplary, illustrative, and non-limiting embodiments. However, it will be recognized by persons having ordinary skill in the art that various substitutions, modifications, or combinations of any of the disclosed embodiments (or portions thereof) may be made without departing from the scope of the invention as defined solely by the claims. Thus, it is contemplated and understood that the present disclosure embraces additional embodiments not expressly set forth herein. Such embodiments may be obtained, for example, by combining and/or modifying any of the disclosed steps, ingredients, constituents, components, elements, features, aspects, and the like, of the embodiments described herein. Thus, this disclosure is not limited by the description of the various exemplary, illustrative, and non-limiting embodiments, but rather solely by the claims. In this manner, it will be understood that the claims may be amended during prosecution of the present patent application to add features to the claimed invention as variously described herein.

We claim:

1. A method of producing a straightened beta-titanium alloy elongated product form, the method comprising:

solution treating a beta-titanium alloy product form having a chemical composition as specified in UNS R58150 or ASTM F2066-13;

aging the solution treated beta-titanium alloy product form in a first temperature range of 482° C. to 510° C.;

applying a stress to the solution treated and aged beta-titanium alloy product form in a second temperature range of ambient temperature to 482° C. for a time sufficient to improve straightness of the solution treated and aged beta-titanium alloy product form, to provide a straightened solution treated and aged beta-titanium alloy elongated product form, wherein the straightened solution treated and aged beta-titanium alloy elongated product form deviates from straight by no greater than 0.0625 inch (1.588 mm) over any 5 foot length (152.4 cm);

stress-relief aging the straightened solution treated and aged beta-titanium alloy elongated product form in a third temperature range of 426° C. to 510° C., to provide a stress-relief aged straightened beta-titanium alloy elongated product form; and air cooling the stress-relief aged straightened beta-titanium alloy elongated product form from the third temperature range without applying a stress to the stress-relief aged straightened beta-titanium alloy elongated product form during the air cooling.

2. The method of claim 1, wherein the stress-relief aging the straightened solution treated and aged beta-titanium alloy elongated product form comprises heating the straightened solution treated and aged beta-titanium alloy elongated product form in the third temperature range for up to 2 hours.

3. The method of claim 1, wherein the stress-relief aging the straightened solution treated and aged beta-titanium alloy elongated product form comprises heating the straightened solution treated and aged beta-titanium alloy elongated product form in the third temperature range for 1 hour to 2 hours.

4. The method of claim 1, wherein the air cooling the stress-relief aged straightened beta-titanium alloy elongated product form from the third temperature range comprises cooling the stress-relief aged straightened beta-titanium alloy elongated product form in an ambient air environment without forced air flow over the stress-relief aged straightened beta-titanium alloy elongated product form.

5. The method of claim 1, wherein the air cooling the stress-relief aged straightened beta-titanium alloy elongated product form from the third temperature range comprises cooling the stress-relief aged straightened beta-titanium alloy elongated product form using a forced air flow over the stress-relief aged straightened beta-titanium alloy elongated product form.

6. The method of claim 1, wherein the air cooling the stress-relief aged straightened beta-titanium alloy elongated product form from the third temperature range is performed without liquid quenching the stress-relief aged straightened beta-titanium alloy elongated product form.

7. The method of claim 1, wherein the straightened solution treated and aged beta-titanium alloy elongated product form deviates from straight by no greater than 0.125 inch (3.175 mm) over any 10 foot (304.8 cm) length of the straightened solution treated and aged beta-titanium alloy elongated product form.

8. The method of claim 1, wherein the stress-relief aged and air cooled beta-titanium alloy elongated product form exhibits an ultimate tensile strength of 1175 MPa to 1230 MPa and a percent elongation of at least 10%.

9. The method of claim 1, wherein the stress-relief aged and air cooled beta-titanium alloy elongated product form exhibits a yield strength of 1080 MPa to 1153 MPa and a percent elongation of at least 10%.

10. The method of claim 1, wherein the stress-relief aged and air cooled beta-titanium alloy elongated product form exhibits an ultimate tensile strength that is at least as great as and is up to 5% greater than an ultimate tensile strength of the straightened solution treated and aged beta-titanium alloy elongated product form.

11. The method of claim 1, wherein the stress-relief aged and air cooled beta-titanium alloy elongated product form exhibits a yield strength that is at least as great as and is up to 6% greater than a yield strength of the straightened solution treated and aged beta-titanium alloy elongated product form.

12. The method of claim 1, wherein the straightened solution treated and aged beta-titanium alloy elongated product form is selected from a billet, a bloom, a round bar, a square bar, an extrusion, a tube, a pipe, a slab, a sheet, and a plate.

13. The method of claim 1, wherein the stress-relief aged and air cooled beta-titanium alloy elongated product form satisfies all of the requirements of ASTM F 2066-13 for wrought Ti-15Mo alloy suitable for use in the manufacture of surgical implants.

14. The method of claim 1, wherein the stress-relief aged and air cooled beta-titanium alloy elongated product form comprises, in weight percentages based on the total alloy:

up to 0.05 nitrogen;
up to 0.10 carbon;
up to 0.015 hydrogen;
up to 0.10 iron;
up to 0.20 oxygen;
14.00 to 16.00 molybdenum;
titanium; and
incidental impurities.

15. The method of claim 1, wherein the stress-relief aged and air cooled beta-titanium alloy elongated product form comprises, in weight percentages based on the total alloy:

up to 0.07 nitrogen;
up to 0.12 carbon;
up to 0.017 hydrogen;
up to 0.20 iron;
up to 0.22 oxygen;
13.75 to 16.25 molybdenum;
titanium; and
incidental impurities.

16. The method of claim 1, wherein the straightened solution treated and aged beta-titanium alloy elongated product form defines a longitudinal axis, and wherein the longitudinal axis is positioned substantially perpendicular to a support structure during the stress-relief aging.

* * * * *